United States Patent [19]

Raaf et al.

[11] 4,149,293

[45] Apr. 17, 1979

[54] ADJUSTABLE BRISTLE TOOTHBRUSH

[75] Inventors: Helmut Raaf, Bad Schwalbach; Oskar Heumann, Wiesbaden-Klarenthal, both of Fed. Rep. of Germany

[73] Assignee: Blendax-Werke R. Schneider & Co., Mainz, Fed. Rep. of Germany

[21] Appl. No.: 919,076

[22] Filed: Jun. 26, 1978

[30] Foreign Application Priority Data

Jul. 1, 1977 [DE] Fed. Rep. of Germany ..... 2790702

[51] Int. Cl.[2] ..... A46B 15/00

[52] U.S. Cl. ..... 15/169

[58] Field of Search ..... 15/168–170, 15/184, 160; 132/119–123

[56] References Cited

U.S. PATENT DOCUMENTS

| | | | |
|---|---|---|---|
| 3,082,457 | 3/1963 | Lucibello et al. | 15/167 |
| 3,172,139 | 3/1965 | Wire | 132/119 |

FOREIGN PATENT DOCUMENTS

| | | | |
|---|---|---|---|
| 647429 | 10/1962 | Italy | 15/169 |

*Primary Examiner*—Peter Feldman

*Attorney, Agent, or Firm*—Connolly and Hutz

[57] ABSTRACT

A toothbrush with a variable adjustment of the operative bristle length, characterized in that it is equipped with a movable perforated plate, arranged over the bristle holder with the bristles extending through the perforations. The plate is adjustable up and down by means of a seesaw or scissor-like mechanism.

4 Claims, 2 Drawing Figures

ADJUSTABLE BRISTLE TOOTHBRUSH

BACKGROUND OF THE INVENTION

The present invention relates to a toothbrush wherein the bristle hardness may be varied by adjusting the operative bristle length.

There has existed for a long time a need for toothbrushes whose bristle hardness may be adjusted by the user. This is desirable in order to be able to impart the suitable and required intensity to the cleaning procedure in accordance with the condition of the teeth and of the gums. The hardness and thus the cleaning power of the bristles is known to be directly correlated to their length. Thus the degree of hardness may be controlled directly by adjustment of the length of the bristles.

Brushes whose bristle length may be varied are known in the art. German Offenlegungsschrift No. 2,107,900 discloses a hardness-adjustable brush, comprising a brush plate, a perforated plate, and a cover. The perforated plate is adjustably arranged opposite the brush plate by means of a threaded pin and a nut thread interacting therewith and the adjustment takes place by means of a control knob or the like arranged above the bristle plate, the control knob being shaped like a drive gear and covered by a cover arranged on the bristle plate.

By means of this device, a hardness adjustment of the brushes may actually be achieved by an up and down movement of the perforated plate. This known device, which in principle should be applicable to toothbrushes, is apparently designed preponderantly for clothes and body scrubbing brushes. This device is a complicated assembly which necessitates a correspondingly expensive finishing. Another drawback of this device which is aggravating for toothbrushes is that the adjustment of the bristle length and thus of the brush hardness cannot be undertaken during the cleaning procedure. Rather, it requires an interruption of the cleaning and a separate regulating by means of the drive gear. Because of the size necessitated by the expensive configuration of the known, hardness-adjustable brush, an application to toothbrushes seems hardly possible.

In toothbrushes, however, it is absolutely necessary that construction be of the utmost simplicity and that adjustment of the bristle length may be achieved during the cleaning procedure.

BRIEF DESCRIPTION OF THE INVENTION

This invention relates to a toothbrush having an adjustable operative bristle length comprising a brush having an elongated handle and a bristle area comprising bristles secured in a base, a perforated plate disposed over said base with the bristles extending through the plate perforations, and means for raising and lowering the perforated plate over the bristle length whereby the operative length of the brush bristles is adjusted.

The means for raising and lowering the perforated plate include an elongated arm attached to the plate and connected to the brush handle by a ball joint pivot whereby the plate may be raised and lowered by a seesaw action. Another means for raising and lowering the plate is an elongated arm attached to the plate and pinned to the brush handle to provide a scissor action between the arm and the handle to effect plate movement.

DETAILED DESCRIPTION OF THE INVENTION

It has now been found that the requirements for toothbrush bristle adjustment may be met in a structurally simple and satisfactory manner if a perforated plate, adjustable in height over the bristle length, is provided to the bristle area of a toothbrush of a known type. The bristle adjustment is achieved in this device by means of a perforated plate which is mounted over the bristle area of the brush handle and which is moved up and down in relation to the brush handle. In a simple manner, even when using the toothbrush, the height of the plate may be varied by means of a seesaw or scissor-like mechanism.

The perforated plate mounted over the brush handle may be constructed in the form of a plate with individual perforations for each individual bristle tuft, and may be in a round, oval or even quadrangular shape. However, perforations in the form of longitudinal or transverse slots corresponding to the bristle tuft rows of the brush head are also within the scope of this invention.

The invention is explained in more detail below by way of the exemplary embodiments illustrated in the drawing.

Figure 1:
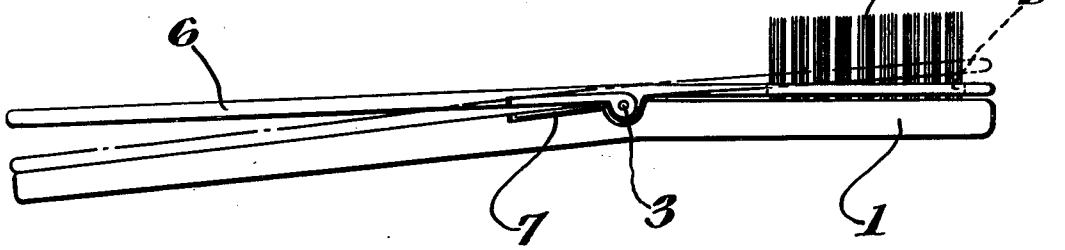
FIG. 1 shows in a side view a toothbrush of this invention having a perforated plate moveable by a seesaw mechanism.

FIG. 1 illustrates a brush base 1 having a head holding bristles 4 and also includes an elongated handle section. Perforated plate 2 engages bristles 4 which pass through the perforations in plate 2. Plate 2 is connected to an elongated arm 6. By ball joint 3, plate 2 and its arm 6 are connected to brush base 1. By means of a seesaw movement wherein ball joint 3 is the pivot, perforated plate 2 may be adjusted in its height and thus the length or height of the bristle tufts which are operative in brushing is varied. In place of the seesaw mechanism illustrated in FIG. 1, the height adjustment of perforated plate 2 may also take place by means of a scissor-like device, illustrated in FIG. 2.

Figure 2:
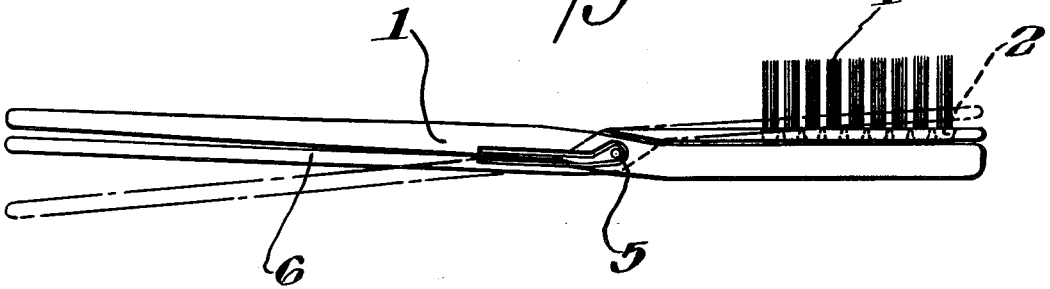
FIG. 2 shows in a side view a toothbrush of this invention having a perforated plate moveable by a scissor mechanism.

In FIG. 2 plate 2 is connected to elongated arm 6. Arm 6 is connected to brush base 1 by a pin connection 5 in such manner that adjustment of the height of plate 2 may be achieved as a result of a scissor-like action between arm 6 and brush base 1.

In both figures, the position of the perforated and bristle plate in a height-adjusted brush is illustrated by broken lines.

Additionally, a spring may be provided between arm 6 and brush handle 1. The spring may be attached between 1 and 6 by means of the ball joint pivot 3 or the pin connector 5. Such spring means would provide a relaxed position and a tension position for perforated plate 2.

We claim:

1. A toothbrush having an adjustable operative bristle length comprising (a) a brush having an elongated handle and a brush head comprising bristles secured in a base;

(b) a perforated plate disposed over said base with the bristles extending through the plate perforations; and (c) means for raising and lowering the perforated plate over the bristle length comprising an elongated arm attached to said plate, the arm being arranged parallel to said elongated handle and connected to said elongated handle by a ball joint pivot whereby said plate may be raised and lowered by a seesaw action with said arm whereby the operative length of the brush bristles is adjusted.

2. A toothbrush according to claim 1 wherein the perforated plate has elongated slots as perforations.

3. A toothbrush having an adjustable operative bristle length comprising (a) a brush having an elongated handle and a brush head comprising bristles secured in a base;

(b) a perforated plate disposed over said base with the bristles extending through the plate perforations; and (c) means for raising and lowering the perforated plate over the bristle length comprising an elongated arm attached to said plate the arm being arranged parallel to said elongated handle and connected to said handle with a pin whereby said plate may be raised and lowered by a scissor action between said arm and said handle whereby the operative length of the brush bristles is adjusted.

4. A toothbrush according to claim 3 wherein the perforated plate has elongated slots as perforations.

* * * * *